United States Patent [19]

Pavlov et al.

[11] 4,034,800

[45] July 12, 1977

[54] CENTRIFUGAL PLANT FOR PRODUCING BIMETALLIC SLEEVES

[76] Inventors: Alexandr Mikhailovich Pavlov, ulitsa Zapadnaya, 9, kv. 90; Alexandr Lukich Pyatibrat, ulitsa Pobedy, 20, korpus 4, kv. 56; Nikolai Dmitrievich Fomenko, prospekt Lenina, 31a, kv. 27; Nikolai Alexeevich Gorbachev, ulitsa Stalevarov, 4, kv. 42; Viktor Loginovich Zotov, ulitsa Sovetskaya, 2/102, kv. 71, all of Elektrostal, Moskovskoi oblasti, U.S.S.R.

[21] Appl. No.: 498,221

[22] Filed: Aug. 16, 1974

[51] Int. Cl.[2] ..... B22D 13/02

[52] U.S. Cl. ..... 164/288; 164/292; 164/297; 164/299

[58] Field of Search ..... 164/288, 292, 297, 299, 164/283 MS, 114, 117, 118, 298, 300, 286; 62/64, 304; 249/137

[56] References Cited

U.S. PATENT DOCUMENTS

| | | | |
|---|---|---|---|
| 1,916,296 | 7/1933 | Barr et al. | 164/152 |
| 1,949,433 | 3/1934 | Russell et al. | 164/20 |
| 2,797,459 | 7/1957 | Myers | 164/297 X |
| 2,833,009 | 6/1958 | Horst | 164/288 X |
| 2,874,412 | 2/1959 | Flemming et al. | 249/137 X |
| 3,467,169 | 9/1969 | Johnsson | 164/288 X |
| 3,659,428 | 5/1972 | Kunioka | 62/64 |

FOREIGN PATENT DOCUMENTS

| | | | |
|---|---|---|---|
| 752,414 | 4/1953 | Germany | 164/288 |
| 454,102 | 9/1936 | United Kingdom | 62/64 |

*Primary Examiner*—Ronald J. Shore
*Assistant Examiner*—Gus T. Hampilos

[57] ABSTRACT

A plant for producing bimetallic sleeves by pouring molten so called babbitt metal into the space of a sleeve being rotated. The plant comprises a head stock and a tail stock mounted on a bed, the tail stock being slidable along the axis of the sleeve being babbitted, each mounting means for centering and clamping the sleeve that is poured in between them with the help of cones set up on the head and the tail stocks.The tail stock mounts a pouring device wherein the babbitt metal to be poured into the sleeve is delivered by a batcher. The pouring device includes a feed funnel adapted to receive the molten babbitt from the batcher, a pipe enclosed in the axis of the sleeve, a connecting pipe supplying the molten babbitt from the feed funnel into the pipe, and a chute onto which the molten babbitt is delivered from the pipe through an opening provided therein. The chute is inclined to the direction of rotation of the sleeve so that the babbitt is fed directly to the internal wall of the rotating sleeve along its entire length and flows off in the direction of its rotation. The sleeve being babbitted is cooled by sprayers mounted along its periphery so that the entire external surface of the sleeve is simultaneously exposed to the effect of the coolant.

3 Claims, 6 Drawing Figures

CENTRIFUGAL PLANT FOR PRODUCING BIMETALLIC SLEEVES

The present invention relates to foundry practice and more particularly to centrifugal plants for producing bimetallic sleeves by free pouring of molten metal into the space of a rotating sleeve.

The invention proves to be most efficient for the production of bimetallically babbitted steel sleeves.

It is known that the quality of babbitting steel pieces is a function of the mode of feeding the molten babbitt onto the internal surface of the sleeve being poured in, the rate of cooling of the babbitted sleeve, the entrappment of foreign matters into the melt being poured, and of the peripheral speed of rotation of the sleeve being babbitted.

Known in the art is a centrifugal plant for producing bimetallic sleeves by pouring a melt, preferably babbitt metal, into the space of a rotating sleeve to be poured in, comprising a bed mounting a fast head stock and a tail stock sliding along the axis of the sleeve being babbitted, said stocks carrying each a disc for centering and clamping the sleeve being babbitted, a drive for rotating the disc of the head stock, a longitudinal transfer gear of the tail stock and a gear for centering and holding the sleeve when molten metal is being poured thereinto, fencing, sprayers for cooling the sleeve together with the poured metal, and a pouring device set up on the tail stock and adapted for feeding metal into the sleeve being babbitted (see e.g. Swedish Patent No. 313,152, Cl. 31*b*2, 13/10).

In the known centrifugal plant the pouring device is a pipe from where molten metal flows off freely inside the sleeve while the cooling means included in the plant is so designed that the coolant is fed only on a fraction of the surface of the sleeve being babbitted. As for the coolant, water supplied through nozzles in stream-like manner under a pressure is used in the above-described plant.

The pouring device employed in the prior-art plant for feeding the molten metal inside the rotating sleeve does not provide a high-quality metal coating since the molten metal flows freely from the above device only on a separate section of the sleeve which adds to the pouring time, causes metal liquation and promotes the occurrence of holes and pores; the cooling device does not ensure the rate of cooling of the babbitted sleeve that is required for obtaining a fine-grain structure of the poured metal.

The main object of the present invention is the provision of a centrifugal plant for producing bimetallic sleeves, wherein the metal poured into the sleeve is fed directly to the sleeve internal wall and simultaneously along its entire length.

Another object of the invention is the attainment of a high cooling rate of the babbitted sleeve.

These and other objects are achieved in the herein-proposed centrifugal plant for producing bimetallic sleeves by pouring molten metal, preferably babbitt, into the space of a rotating sleeve being poured in, comprising a bed mounting a stationary head stock and a tail stock slidable along the axis of the sleeve being babbitted, the stocks carrying each means for centering and clamping the sleeve, a drive for rotating the centering and clamping means, this means being set up on the head stock, a longitudinal transfer gear of the tail stock, a gear for centering and holding the sleeve when it is being poured with the molten metal, fencing, sprayers for cooling the sleeve with the metal poured thereinto, and a pouring device mounted on the tail stock and adapted for feeding the metal into the sleeve being babbitted.

According to the invention, the pouring device has a pipe for feeding the metal installed along its axis inside the sleeve being babbitted and a chute to which the metal is delivered through an opening in the pipe, the chute being inclined to the direction of rotation of the sleeve so that the metal is fed directly to the internal wall of the rotated sleeve along its entire length flowing off in the direction of the sleeve rotation. The sprayers are mounted along the periphery of the sleeve being poured so that the entire external surface of the sleeve is simultaneously exposed to the effect of the coolant.

The herein-proposed pouring device enables rapid supply of the molten metal to the internal surface of the sleeve being babbitted, simultaneously along its entire length, precluding thereby liquation of the metal being poured and the occurrence of air holes and pores. Simultaneous cooling of the entire surface of the babbitted sleeve secures a stable fine-grain structure of the poured metal. All this extends the service life of the metallic sleeves produced.

It is suggested that the sprayers for obtaining a finely dispersed air - water moisture employed as a coolant be provided with separate closed air and water chambers connected to respective air and water supply pipe lines and communicating with one another through small perforations in their partition, the water chamber being mounted on the side of the sleeve being babbitted, the chamber wall facing the sleeve being fitted with holes through which the coolant is supplied onto the sleeve.

With the above-described construction of the sprayers a finely dispersed pulverized air - water mixture is obtainable, the mixture featuring high heat capacity and contributing to the rapid cooling of the babbitted sleeve.

It is also recommended that the sprayers be mounted uniformly along the entire internal surface of the fencing whose overall dimensions are determined by the maximum size of the sleeve being babbitted, enabling the development of a more compact centrifugal plant for producing bimetallic sleeves of different types and sizes.

To change the size of the cooling zone in accordance with the sleeve length, the pipe lines for supplying air and water into the sprayers are suggested to be arranged in pairs in a ring-shaped manner along the entire fencing, and separately connected to water and air headers, the sprayers being uniformly mounted along each pair of the pipe lines, the sprayer chambers being connected to the respective water and air supply pipe lines, forming thereby annular cooling sections, the quantity of the sections cut-in being dependent on the length of the sleeve to be cooled, which makes it possible to attain a maximum cooling effect alongside with a reduction in coolant consumption.

It is also recommended that the hole in the pipe delivering the metal being poured into the chute be made as a longitudinal horizontal slot which allows supplying the molten metal along the entire length of the internal wall of the sleeve being poured.

The present invention will be better understood from a consideration of a detailed description of an exemplary embodiment thereof, to be had in conjunction with the accompanying drawings, wherein.

Figure 1:
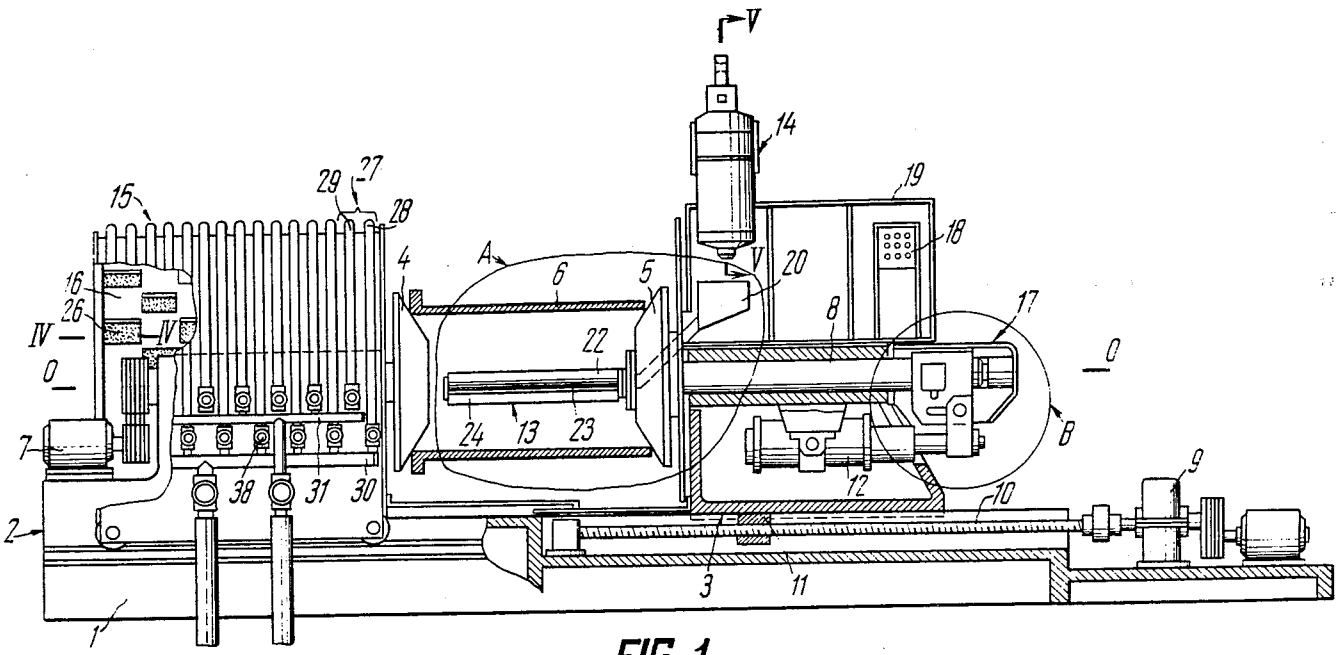
FIG. 1 is a layout of a centrifugal plant for producing bimetallic sleeves according to the invention, in a longitudinal sectional view.

Mounted on a bed 1 (FIG. 1) are a stationary head stock 2 and a slidable tail stock 3 fitted each with respective cones 4, 5 for centering a sleeve 6 being babbitted.

The cone 4 is fixed on a head stock driving shaft (not shown in the drawing) which is brought into rotation by a drive 7, while the cone 5 is set up freely on a non-revolvable shaft 8 which in turn is movably mounted in the tail stock being displaced along its axis.

The bed 1 mounts a gear 9 capable of carrying the tail stock 3 towards an axis O—O of the sleeve 6 with the aid of a screw 10 and a nut 11 fixed on the tail stock 3.

Figure 2:
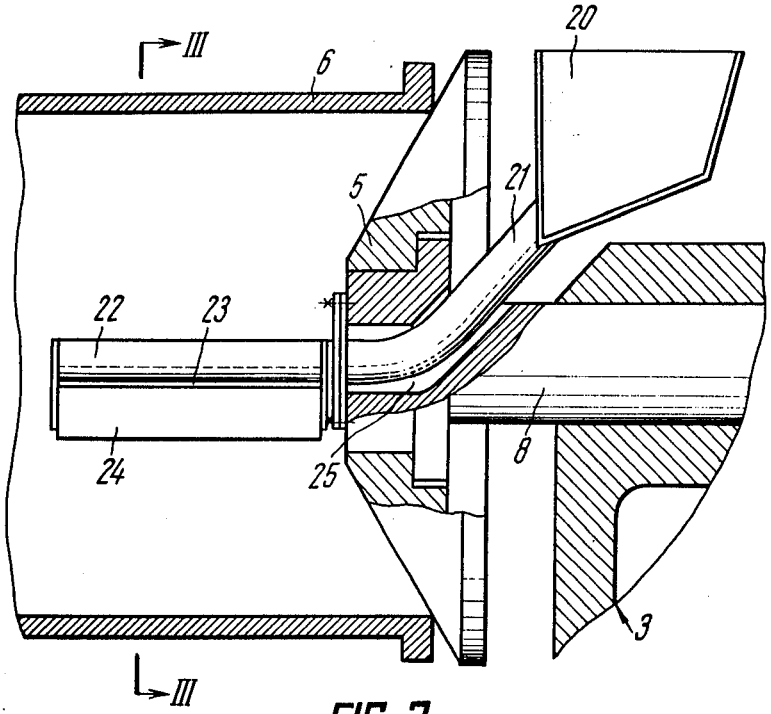
FIG. 2 shows a unit "A" of FIG. 1 with a fragmentary cutaway (scaled up)
Figure 3:
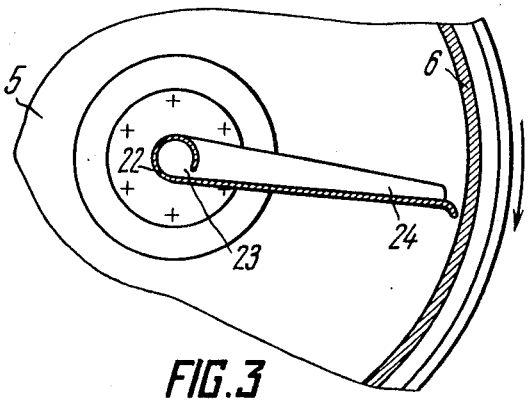
FIG. 3 is a section III—III in FIG. 2.

The sleeve 6 is centered and held in the cones 4 and 5 in the course of pouring the molten metal — babbitting with, the help of a pneumatic drive 12 mounted on the tail stock 3. The tail stock 3 carries also a pouring device 13 (FIGS. 1, 2 and 3) wherein the babbitt metal being poured is fed from a batcher 14.

For cooling the sleeve 6 and the poured babbitt provision is made for a cooling device 15 set up on a fencing 16 movable along the axis O—O.

Figure 6:
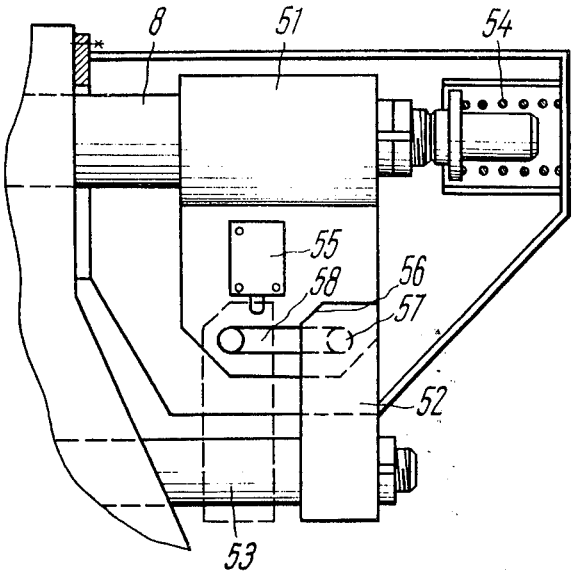
FIG. 6 is a unit "B" of FIG. 1 (scaled up).

With a view to stop the tail stock 3 as it is shifted by the gear 9 to its working position, the tail stock is provided with an interlocking device or unit 17 (FIGS. 1, 6).

The centrifugal plant is controlled from a control panel 18 installed on a working platform 19 which is arranged on the tail stock 3. The herein-proposed centrifugal plant is equipped with known automatic controls (not shown in the drawing) ensuring automatic adjustment of the pouring process.

The pouring device 13 is provided with a feed funnel 20 wherein the babbitt being poured is delivered from the batcher 14, with a connecting pipe 21 through which the feed funnel 20 communicates with a pipe 22 for feeding the molten babbitt therein, the pipe 22 having a longitudinal slot 23, and with a chute 24 for supplying the babbitt directly to the internal wall of the sleeve 6 being babbitted.

The connecting pipe 21 passes through an opening 25 in the shaft 8 of the tail stock 3. The pipe 22 is placed horizontally inside the sleeve 6 along its axis, while the chute 24 is inclined to the direction of rotation of the sleeve 6 at an angle ensuring conformity between the rate of feeding the babbitt onto the rotating sleeve and its peripheral speed.

The optimum angle of inclination of the chute 24 is determined by the specific conditions of the pouring process (the level of the molten babbitt within the pouring device, the chute width, the peripheral speed of rotation of the sleeve being babbitted, etc.).

The cooling device 15 has sprayers 26 (FIGS. 1, 4) staggered over the entire internal surface of the fencing 16. The sprayers 26 are combined into annular cooling sections 27 with the aid of water supply pipe lines 28 and air supply pipe lines 29. The pipe lines 28 and 29 run in pairs along the periphery of the fencing 16 and are connected separately to a water header 30 and an air header 31, respectively. The babbitted sleeve is cooled with an air - water coolant. To this end the sprayers 26 are of the double-chamber type.

Figure 4:
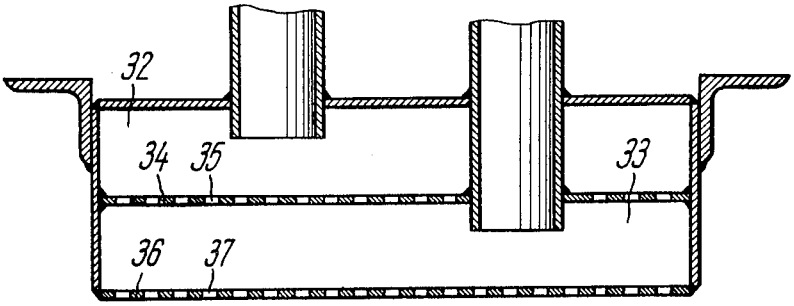
FIG. 4 is a section IV—IV in FIG. 1 (scaled up)

A sectional view of a sprayer is shown in FIG. 4. A chamber 32 is connected to the air supply pipe line 29 and the chamber 33 to the water supply pipe line 28. A partition 34 separating the chambers is fitted with small perforations 35 for supplying air from the chamber 32 into the chamber 33. For feeding the air - water mixture from the chamber 33 onto the sleeve 6 being cooled the chamber wall 36 facing the sleeve 6 has holes 37.

Such sprayers make it possible to obtain the coolant in the form of a finely dispersed air - water mixture featuring a high heat capacity.

Owing to the individual connection of the water supply lines 28 and air supply pipe lines 29 of the cooling sections 27 to the water and air headers 30, 31 respectively, the size of the cooling zone can be altered, depending on the sleeve length, by changing the quantity of the cooling sections put in service.

The pipe lines 28 and 29 are put in operation with the help of valves 38.

Figure 5:
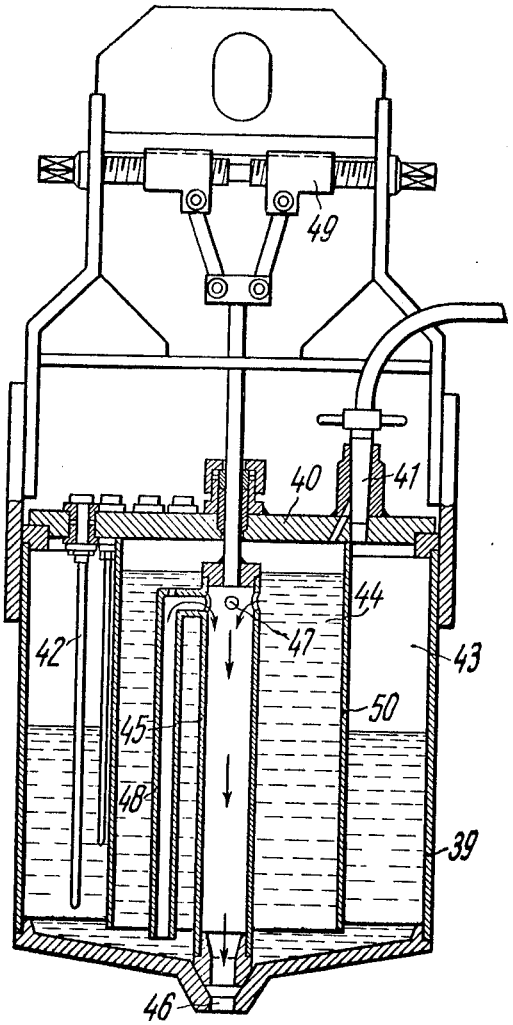
FIG. 5 is a section V—V in FIG. 1 (scaled up)

The pneumoelectric batcher 14, shown in detail in FIG. 5, is intended for proportioning and reducing the liquational processes in the molten babbitt supplied into the feed funnel 20 of the pouring device 13.

The batcher 14 is cylinder-shaped and comprises a case 39 sealed hermetically with a cover 40. The cover 40 mounts a connecting branch 41 for supplying dehumidified gas (air) and liquid babbitt level gauges 42 arranged in an external space 43.

Mounted in the internal space 44 of the batcher 14 is a hollow stopper 45 plugging an opening 46 in the bottom of the case 39 and adapted for filling the batcher with the molten babbitt. The hollow stopper 45 has drains 47 disposed in the upper portion of the stopper. One or more drains communicate with the lower babbitt layers through a connecting pipe 48. The opening 46 in the bottom of the case 39 is opened and closed by the stopper 45 with the help of a gear 49.

The cylinder-shaped spaces 43 and 44 are separated by a wall 50, are aligned axially with each other, and communicate with one another in the lower portion of the batcher 14.

FIG. 6 shows the interlocking unit or device 17 of the gear 9 adapted to transfer the tail stock 3. The unit 17 is provided with a bracket 51 set up on the shaft 8, a bracket 52 mounted on a rod 53 of the pneumatic drive 12 and with a pressure spring 54 for preliminary clamping of the sleeve 6 between the cones 4 and 5.

Fastened to the bracket 51 is a limit switch 55 that disengages the gear 9 after the sleeve 6 has been preliminarily centered and clamped in the cones 4 and 5 with the help of the spring 54. The bracket 52 has a taper 56 interacting with the limit switch 55 and is fitted with a pin 57 mounted freely in a slot 58 of the bracket 51.

After the final centering and clamping of the sleeve 6 in the cones 4 and 5, which is effected with the aid of the pneumatic drive 12, the pin 57 is at first free to move along the entire length of the slot 58 and then displaces the shaft 8 by acting on the bracket 51.

The centrifugal plant operates in the following manner. Upon being tinplated the sleeve 6 is mounted with the help of a lifting or loaded device (not shown in the drawing) between the cones 4 and 5 of the centrifugal plant. Next the gear 9 is actuated by depressing a button on the control panel 18.

The gear 9 brings into rotation the lead screw 10 which imparts, with the aid of the nut 11, a reciprocating motion to the tail stock 3 sliding along the axis O—O of the sleeve 6 towards the head stock 2. As the cone 5 of the tail stock 3 approaches the head stock 2, the sleeve 6 is previously centered and forced against the cone 4.

Both the preliminary centering the clamping of the sleeve 6 is effected owing to compression of the spring 54 when the tail stock 3 moves in relation to the shaft 8 which latter remains stationary at the moment.

The displacement of the tail stock 3 and compression of the spring 54 continue until the taper 56 of the bracket 52 interacts with the limit switch 51 whereupon the gear 9 is brought out of operation and the pneumatic drive 12 is actuated.

The pneumatic drive 12 freely transfers the rod 53 with the bracket 52 and the pin 57 to the sleeve 6 within the limits of the slot 58 of the bracket 51. Further the pin 57 acts on the bracket 51, centering the clamping the sleeve 6 completely in the cones 4 and 5 through the shaft 8 of the tail stock 3. The sleeve 6 remains clamped by the pneumatic drive 12 until the babbitting process is completed.

Next the fencing 16 with the cooling device 15 mounted thereon is carried along the axis O—O into the zone of the sleeve 6 being babbitted.

The pneumoelectric batcher 14 filled with the babbitt metal is set up by a lifting device (not shown in the drawing) above the feed funnel 20, the babbitting operation being hereinafter carried out under automatic control. The sleeve 6 is brought into rotation by the drive 7 of the cone 4.

By depressing the button on the control panel 18 the batcher 14 and the cooling device 15 are put in operation. In this case compressed gas (air) is fed into the external space 43 of the batcher 14, forcing out the molten babbitt into the internal space 44. Then the babbitt is delivered from the internal space 44 through the connecting pipe 48 and the drains 47, as shown by arrows in FIG. 5, into the hollow stopper 45 flowing off therefrom into the feed funnel 20 of the pouring device 13.

The batcher 14 discharges a certain amount (volume) of babbitt, that is adjusted by the level gauges 42. Upon draining a certain amount of the babbitt, the level gauge 42 is actuated, cutting off the gas supply into the batcher 14 and putting in operation the cooling device 15.

Following that the babbitt metal is passed along the connecting pipe 21 into the pipe 22 and, coming out of the longitudinal horizontal slot 22, fills uniformly the chute 24, running off from it along the entire length of the sleeve 6 being babbitted.

The babbitt running off in the direction of rotation of the sleeve 6 is entrained by the interal surface of the rotating sleeve which is held in place on the internal surface by centrifugal forces, thus producing a uniform layer of babbitt on the sleeve exterior.

After a certain time period needed for the sleeve 6 to cool down, the coolant supply is cut off. Then the drive 7 rotating the cone 4 is disengaged. After the sleeve 6 has stopped, the fencing 16 is shifted to its inoperative position and the sleeve 6 is prepared for transportation with the help of the lifting device.

Further, the tailstock 3 is transferred by the gear 9 from the babbitting zone to the head stock 2 until the pouring device 13 emerges from the sleeve 6. As the tail stock 3 is being displaced in the above-mentioned direction, the spring 54 operates to return the shaft 8 with the cone 5 into its initial inoperative position. We claim:

1. A centrifugal plant for producing thin-walled bimetallic sleeves (6) by pouring molten metal into the space of a sleeve that is rotated, the plant comprising: a bed (1); a stationary head stock (2) fixed rigidly on said bed; a tail stock (3) mounted movably on said bed and slidable along the axis of the sleeve being produced; cones (4,5) for high-precision centering and clamping the sleeve with direct contact from both sides, said cones being respectively set up on said head stock and said tail stock; a drive (7) mounted on said head stock for bringing its cone into rotation; a gear (9) installed on said bed for carrying said tail stock; a pneumatic drive (12) operatively associated with paid tailstock for centering and holding the sleeve between said cones in the course of the pouring of the metal so as to be rotated by said cones during the pouring; a fencing (16) mounted on said bed, movable towards the sleeve axis; a non-rotatable pouring device (13) operatively associated with one of said cones and provided with a pipe (22) insertable into the sleeve and along the axis of the latter, into which pipe the metal is fed, and which has an elongated opening (23) for discharging the metal; a chute (24) to which the metal is supplied through said elongated opening, said chute being rigidly connected to said pipe, inclined to the direction of rotation of the sleeve, and extending into close proximity of the internal wall of the rotated sleeve, so that the metal supplied to said chute is fed directly to said internal wall along the entire length of the sleeve, and flows off in the direction of rotation; means for forcefully feeding the metal into said pipe; and sprayers (26) staggered over the internal surface of said fencing and substantially annularly disposed for cooling the sleeves with a finely dispersed coolant, surrounding the outer periphery of the sleeve so that the entire external surface thereof is simultaneously exposed to the effect of the coolant.

2. The centrifugal plant as defined in claim 1, wherein said discharging opening of the pipe of the pouring device is a longitudinal horizontal slot.

3. The centrifugal plant as defined in claim 1, wherein said sprayers have separate air and water chambers interconnected with one another through fine perforations provided in a partition therebetween, said water chamber being set up on the side of the sleeve being produced, and having holes facing the sleeve to supply the coolant onto the sleeve.

* * * * *